United States Patent [19]

Kanbe

[11] Patent Number: 4,511,315

[45] Date of Patent: Apr. 16, 1985

[54] LIQUID METAL MECHANICAL PUMP

[75] Inventor: Mitsuru Kanbe, Yokohama, Japan

[73] Assignee: Doryokuro Kakunenryo Kaihatsu Jigyodan, Tokyo, Japan

[21] Appl. No.: 479,077

[22] Filed: Mar. 25, 1983

[30] Foreign Application Priority Data

Mar. 30, 1982 [JP] Japan ..... 57-52158

[51] Int. Cl.[3] ..... F04B 39/02; F01D 25/08

[52] U.S. Cl. ..... 417/366; 417/373; 417/424; 415/175; 376/203

[58] Field of Search ..... 417/368, 366, 373, 901, 417/902, 424; 415/111, 112, 175; 376/203, 205, 206

[56] References Cited

U.S. PATENT DOCUMENTS 3,700,551 10/1972 Germer ..... 376/203
3,951,738 4/1976 George et al. ..... 376/203
4,065,232 12/1977 Stratienke ..... 417/368

FOREIGN PATENT DOCUMENTS 176390 10/1982 Japan ..... 415/175

*Primary Examiner*—Richard E. Gluck
*Assistant Examiner*—Peter M. Cuomo
*Attorney, Agent, or Firm*—Wenderoth, Lind & Ponack

[57] ABSTRACT

A liquid metal mechanical pump, having therein a liquid metal free surface and a cover gas space over the liquid metal free surface, is equipped with an emergency gas line shut-off system. This system can shut off a cover gas line by the solidification of liquid metal to thereby prevent the leakage of cover gas and the rise of the liquid metal level in the pump at the time of the failure of the cover gas line. The mechanical pump may further be equipped with an emergency syphon system which can discharge liquid metal when the liquid metal level in the pump exceeds a predetermined level.

8 Claims, 9 Drawing Figures

Level
0
Elapsed time after gas line failure
22
20
25
24
23
21

9
10
11
12
15
14
7
13
8
4
2
5
3
1
6

LIQUID METAL MECHANICAL PUMP

BACKGROUND OF THE INVENTION

1. Field of the Invention

This invention relates to a vertical free surface type pump and more particularly, to a mechanical pump for a liquid metal. The pump includes an emergency cover gas line shut-off system for preventing gas release by solidified liquid metal and further includes an emergency syphon system for discharging an excess volume of liquid metal in a pump casing, to thereby prevent the free surface in the pump casing from rising up to an upper mechanical bearing at the time of failure of the cover gas line. 2. Description of the Prior Art A vertical, free surface type mechanical pump having a construction which includes the free surface of liquid metal inside a pump casing and in which a cover gas space is disposed over the free surface of the liquid metal is the most ordinary type used as a primary circulating pump for a loop-type, liquid metal-cooled, fast breeder reactor. An example of such a mechanical pump is shown in FIG. 1A. Liquid sodium flows into a substantially cylindrical casing 1 from a suction nozzle 2 at the lower end of the casing 1, obtains a delivery pressure from an impeller 3, and flows out from a delivery nozzle 4. The liquid metal entering an overflow column 6 through an overflow pipe 5 is again returned to the suction nozzle 2. A drive shaft 7 for transmitting the rotating force to the impeller 3 is pivotally supported by a lower hydrostatic bearing 8 and an upper mechanical bearing 9. A mechanical seal 10 is disposed below the mechanical bearing 9 so as to prevent the leakage of a cover gas (i.e. an inert gas) from the casing 1. The inert gas is caused to constantly flow downwards from the mechanical seal 10 in order to prevent the vapor of the liquid metal from rising into the seal and, at the same time, to apply a predetermined cover gas pressure, thereby setting the level of the free surface inside the pump and providing a required suction head necessary for the pump.

In the example of the prior art shown in FIG. 1A, the cover gas is supplied from a gas feed pipe 11 fitted to the lower part of the mechanical seal 10, descends through the gap between a shield plug 12 and the shaft 7, then enters a cover gas space 13 and is recovered through a gas discharge pipe 14 connected to the overflow column 6 and through an exhaust pipe 15. Thus, the cover gas circulation is effected. Accordingly, if the cover gas line or piping for the above-described cover gas circulation is accidentally broken, the free surface inside the pump drastically rises and, at times, it reaches the mechanical seal 10 as well as the mechanical bearing 9, thus causing serious damage to the pump and the leakage of the liquid metal. Even if the free surface does not rise up to the mechanical seal 10, the atmospheric gas at the broken portion of the cover gas line would mix with the cover gas in the pump and would oxidize the liquid metal in the pump.

The free surface inside the pump as well as the free surface inside the overflow column 6 shown in FIG. 1A are those surfaces established when the pump is under normal operation. FIG. 1B shows the changes in the free surfaces inside the pump and inside the overflow column when the pump is used as a primary circulating pump of the primary cooling system of a liquid metal-cooled, fast breeder reactor and the gas feed pipe 11 or exhaust pipe 15 is broken. The ordinate in FIG. 1B corresponds to the height in FIG. 1A and the abscissa represents the elapsed time after the gas line failure. Each curve in FIG. 1B has the following meaning. Reference numeral 20 represents a pump free surface; reference numeral 21 represents an overflow column free surface; reference numeral 22 represents a cover gas pressure in a reactor vessel (represented by the head of the liquid metal); reference numeral 23 represents the upper end position of the gas line 14; reference numeral 24 represents the lower surface position of the shield plug 12; and reference numeral 25 represents the position of the gas feed pipe 11.

In this case, since the cover gas line of the pump is communicated with a cover gas system of a reactor vessel 30 as shown in FIG. 2, the gas pressure inside the pump drops down to the atmospheric pressure within a short period of time if the gas line in the proximity of the pump is broken. On the other hand, since the capacity of a gas space 31 in the reactor vessel 30 is by far greater than the pump, it is known that it takes more than one minute before the cover gas pressure on the side of the reactor vessel drops down to the atmospheric pressure. In the interim, unbalance of the gas pressure develops between the reactor vessel and the pump so that the free surface inside the pump rises due to this pressure difference. In other words, the free surface inside the overflow column 6 rises simultaneously with the failure of the gas line and, when it reaches the same level as the free surface inside the pump, both rise together. However, when the free surface reaches the upper end of the gas line 14, the free surface inside the overflow column 6 can hardly rise any longer and only the free surface inside the pump continues rising. At this point, the cover gas pressure in the reactor vessel 30 has still a high pressure so that the free surface inside the pump reaches the shield plug 12, the mechanical seal 10 and the mechanical bearing 9, thereby not only causing serious damage to the pump but also inviting the leakage of the liquid metal outside the pump. This danger becomes more serious in the case of the cold leg pump arrangement because the cover gas pressure during operation is higher than that of the hot leg pump arrangement.

Incidentally, in FIG. 2, reference numeral 32 represents an outlet nozzle; reference numeral 33 represents a main cooling pipe; reference numeral 34 represents a drain valve; reference numeral 35 represents a drain tank; and refernce numeral 36 represents a cover gas refiner.

SUMMARY OF THE INVENTION

An object of the present invention is therefore to provide a mechanical pump for a liquid metal which pump eliminates the drawbacks of prior art mechanical pumps and can prevent the free surface inside the pump from rising and reaching an upper mechanical bearing of the pump even if the failure of a cover gas line of the pump occurs.

Hence, the liquid metal mechanical pump according to the invention can prevent damage of the upper mechanical bearing and mechanical seal. By the rise up of the liquid metal in the pump, the pump can prevent the leakage of the liquid metal from the mechanical seal and can minimize possible trouble that the atmospheric gas can cause at the position of the failed cover gas line if such atmospheric gas is mixed with the cover gas in the pump i.e. the liquid is oxidized in the pump if the failure of the cover gas line occurs.

To accomplish these objects, according to the present invention, an emergency gas line shut-off system is incorporated in a conventional liquid metal mechanical pump comprising a pump casing having therein a free surface of liquid metal and a cover gas space over the liquid metal free surface, a gas line for feeding a cover gas into said cover gas space, and a gas line for exhausting the cover gas from said cover gas space.

The emergency gas line shut-off system has a construction in which the gas feed line is cut at the outside of and in the proximity of the pump casing and resulting open ends of the gas feed line are inserted into a first air-tight freeze pot so as to communicate with each other via the first freeze pot. The gas exhaust line is also cut at the outside of and in the proximity of the pump casing and resulting open ends of the gas exhaust line are inserted into a second air-tight freeze pot so as to communicate with each other via the second freeze pot.

The first and second freeze pots are each connected to the pump casing via a first freeze pot pipe and a second freeze pot pipe, respectively, through which the liquid metal in the pump casing flows out into the first and second freeze pots when the free surface of the liquid metal inside the pump casing rises to a predetermined level higher than that of the normal operation of the pump.

The preferred embodiment of the mechanical pump according to the present invention is further provided with an emergency syphon system and a dump tank for liquid metal. The emergency syphon system comprises an emergency syphon pipe connecting the pump casing and the dump tank. The liquid metal in the pump casing flows out into the dump tank when the free surface of the liquid metal inside the pump casing rises to a predetermined level higher than that of the normal operation of the pump.

Other and further objects of the present invention will become more apparent in the following description and the accompanying drawings in which like reference numerals refer to like constituents.

DETAILED DESCRIPTION OF THE PREFERRED EMBODIMENTS

Figures 1A, 1B:
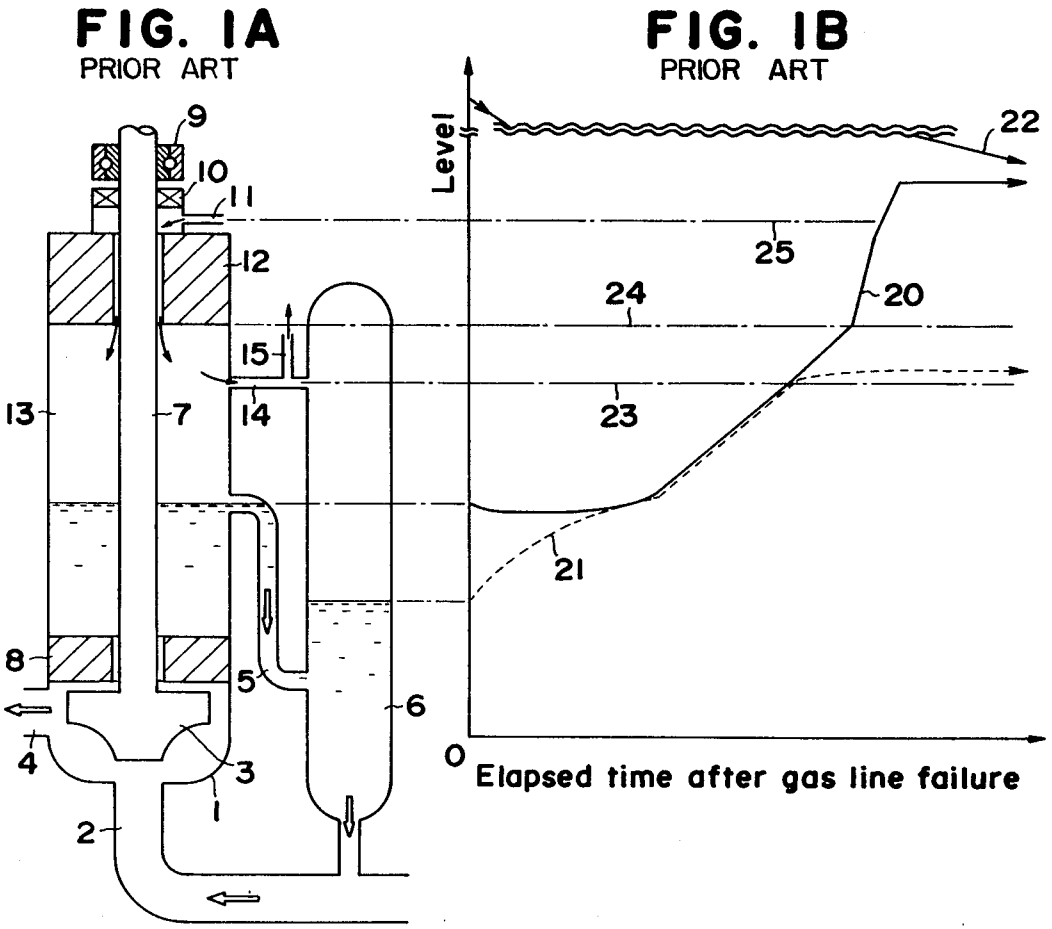
FIG. 1B PRIOR ART
FIG. 1A PRIOR ART
FIGS. 1A and 1B show an example of a conventional mechanical pump and the changes in the free surfaces of liquid metal at the time of failure of the cover gas line.
Figure 3:
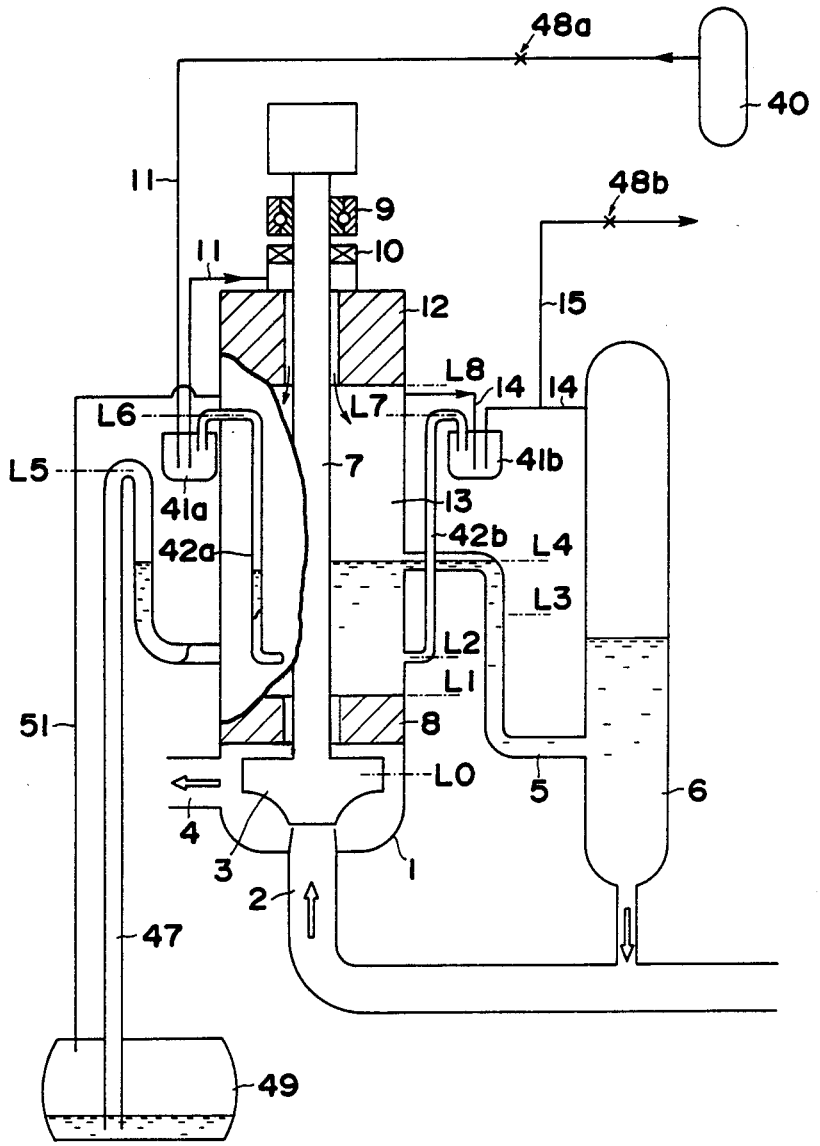
FIG. 3 is a schematic view showing one embodiment of a mechanical pump of the present invention.

Referring now to FIG. 3, there is illustrated a mechanical pump according to one embodiment of the present invention. Since the fundamental construction is the same as that of the prior art shown in FIG. 1A, like reference numerals are used to identify like constituents as in FIG. 1A and their explanation is omitted. The pump of this embodiment is equipped with an emergency gas line shut-off system as well as with an emergency syphon system. The levels shown in FIG. 3 are as follows:

- L0 . . . impeller center level;
- L1 . . . minimum liquid level at which hydrostatic bearing is not exposed;
- L2 . . . level at which emergency syphon pipe and freeze pot syphon pipes are fitted to pump;
- L3 . . . minimum liquid level inside pump during pump operation;
- L4 . . . overflow level inside pump;
- L5 . . . level at which emergency syphon operates;
- L6 . . . level at which freeze pot syphon on the feed side operates;
- L7 . . . level at which freeze pot syphon on the exhaust side operates; and
- L8 . . . lower surface level of shield plug.

The liquid levels inside the pump casing 1 and inside the overflow column 6 shown in FIG. 3 are those existing under the normal operating condition without the gas line failure.

The emergency gas line shut-off system has the following construction. A gas feed pipe 11 extending from a gas header 40 to the lower portion of a mechanical seal 10 and a gas exhaust pipe 14 extending from a cover gas space 13 in the pump to an overflow column 6 are respectively cut at the outside of and in the proximity of a pump casing 1, and their open ends are inserted into and close to the bottom of air-tight freeze pots **41*a* and 41*b*, respectively. Each gas line on both feed and exhaust sides is therefore connected via the corresponding freeze pot 41*a*, 41*b*. The portions between the freeze pots 41*a*, 41*b* and the casing 1 are connected by freeze pot syphon pipes 42*a*, 42*b*, respectively. These syphon pipes 42*a*, 42*b* are equipped with electric heaters and covered with a heat insulating material so that they are always held at a temperature higher than the solidifying point of the liquid metal. On the other hand, the freeze pots 41*a*, 41*b* and the gas line are held at a temperature lower than the solidifying point of the liquid metal. In the case of liquid sodium, for example, the freeze pots 41*a*, 41*b* and the gas line may be kept at normal temperature. Complete air-tightness must be secured for the main bodies of these freeze pots 41*a*, 41*b***. This air-tightness and the inserting portions of the pipes into the freeze pots, and this can be accomplished by welding.

The operation of the emergency gas shut-off system will be explained with reference to FIGS. 4A–4C. Although FIGS. 4A–4C illustrate the case in which the gas line on the exhaust side is broken, the case in which the gas line on the feed side is broken is exactly the same.

Figure 4A:
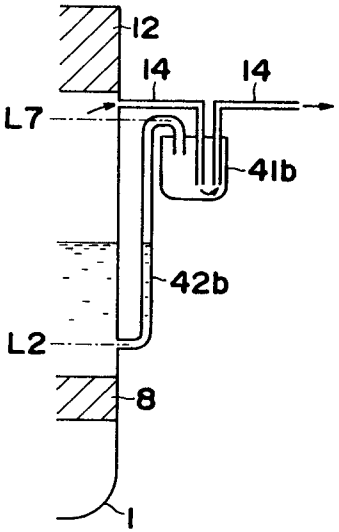
FIGS. 4A to 4C are schematic views useful for explaining an emergency gas line shut-off system at the time of failure of the cover gas line.
Figure 4B:
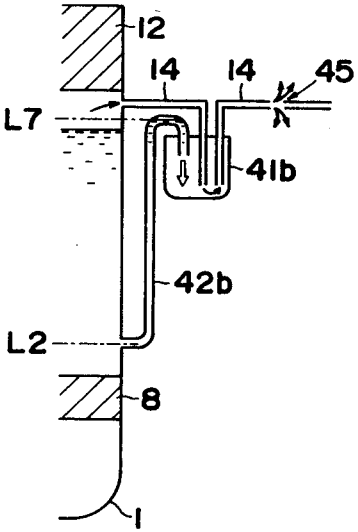
Figure 4C:
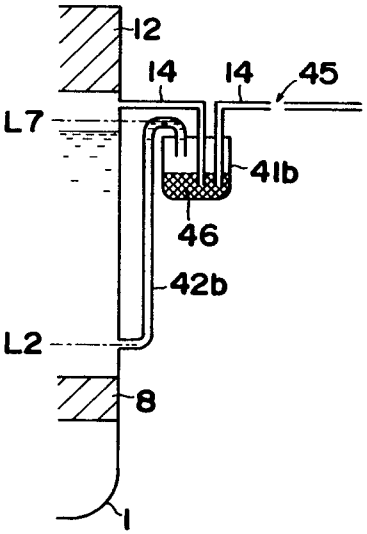

As described hereinbefore, the freeze pot **41*b* is air-tight and the two gas pipes 14 inserted into the freeze pot are communicated as a single pipe during normal operation (see FIG. 4A). In this case, the free surfaces inside the pump and inside the syphon 42*b* are lower than the syphon operation level L7 so that the liquid metal does not flow into the freeze pot 41*b*. However, if the gas line 14 is broken at the position indicated by reference numeral 45 in FIG. 4B, the free surface inside the pump rises. When the free surface inside the syphon 42*b* reaches the level L7 as shown in FIG. 4B, the liquid metal starts flowing into the freeze pot 41*b*. Since the syphon pipe 42*b* is covered with the heat insulating material and is always held at a temperature higher than the solidifying point of the liquid metal, the liquid metal smoothly flows into the freeze pot 41***b* without clogging the syphon pipe 42*b*. On the other hand, the freeze pot 41*b* is held at a temperature below the solidifying point of the liquid metal so that the liquid metal that has flown into the freeze pot 41*b* is solidified (represented by reference numeral 46) as shown in FIG. 4C and chokes up the gas line 14. In this manner, if the gas line is broken, the liquid metal inside the pump casing is supplied to the freeze pot 41*a*, 41*b* on the feed side or on the exhaust side and is cooled and solidified inside the freeze pot 41*a*, 41*b* so that the broken gas line is shut off from the pump side. As can be understood from the foregoing explanation, the lower open end portions of the gas pipes inside the freeze pots 41*a*, 41*b* are preferably as close as possible to the pot bottom. Such an arrangement accelerates the shut-off of the lines.

Turning back to FIG. 3, the mechanical pump of this embodiment is further provided with the emergency syphon system which comprises an emergency syphon pipe 47 connecting the pump casing 1 and a dump tank 49. This emergency syphon pipe 47 is covered with a heat insulating material and is always held at a temperature higher than the solidifying point of the liquid metal. A gas line 51 is connected to the dump tank 49 and the cover gas inside the dump tank 49 is communicated with the inside of the pump. In FIG. 3, if the gas line is broken at the position of reference numeral 48*a* or 48*b* and the free surface inside the pump rises to the level L5, the emergency syphon pipe 47 starts operating and the liquid metal inside the pump is discharged into the dump tank 49 through the syphon pipe 47. This syphon function continues until the free surface inside the pump drops down to the level L2.

The abovementioned emergency gas line shut-off system and emergency syphon system can function independently of each other, and multiple safety can be ensured by equipping both of these systems. The features of these systems can be compared as follows. The emergency gas line shut-off system can completely isolate the pump from the broken portion of the gas line and can therefore prevent the atmospheric gas from mixing into the cover gas and can minimize the damage of the oxidation of the liquid metal in the pump by the atmospheric gas. However, since the gas line of the freeze pot 41*a*, 41*b* and in the proximity thereof is closed by the liquid metal, the pump operation can not be re-started unless this closed portion is replaced. In contrast, the emergency syphon system can be operated once again by simply returning the liquid metal discharged through the emergency syphon pipe 47 into the dump tank 49 to the liquid metal circulation loop in which the pump is disposed. However, mixing of the atmospheric gas from the broken pipe portion can not be prevented by the emergency syphon system.

If the mechanical pump is equipped with these two systems, the operation timing (which function is actuated first) can be freely decided and the most suitable system configuration can be made in accordance with the requirements of the system in which the pump is disposed. In any case, these functions must be actuated before the free surface inside the pump reaches the lower surface level L8 of the shield plug 12. This condition can be expressed by the following formula:

$$(L5-L0)<(L8-L0) \quad (1)$$

$$(L6-L0)<(L8-L0)-\Delta P_2/\gamma \quad (2)$$

$$(L7-L0)<(L8-L0)+\Delta P_3/\gamma \quad (3)$$

where $\Delta P_2$: pressure loss in gas line between pump and freeze pot on the feed side;

$\Delta P_3$: pressure loss in gas line between pump and freeze pot on the exhaust side;

$\gamma$: specific weight of liquid metal.

First, the condition in which the two freeze pots 41*a*, 41*b* operate simultaneously can be obtained by replacing the inequality sign (<) with the equality sign (=) in the formulas (2) and (3) and making a subtraction on each side, i.e.

$$L6=L7-(\Delta P_2+\Delta P_3)/\gamma$$

Next, the condition in which the freeze pots 41*a*, 41*b* and the emergency syphon pipe 47 operate simultaneously can be likewise obtained as follows:

$$L5=L6+\Delta P_2/\gamma$$

From the above, the condition in which the emergency syphon pipe 47 first operates is given as follows:

$$L5-L0<L6-L0+\Delta P_2/\gamma,$$

and $$L6-L0=L7-L0-(\Delta P_2+\Delta P_3)/\gamma.$$

On the other hand, the condition in which the two freeze pots 41*a*, 41*b* operate first can be given as follows:

$$L5-L0>L6-L0+\Delta P_2/\gamma,$$

and $$L6-L0=L7-L0-(\Delta P_2+\Delta P_3)/\gamma.$$

Next, some design examples will be described. In the case of a mechanical pump for a secondary cooling system of a fast breeder reactor, for example, the cover gas pressure in such a pump is high (1 kg/cm$^2$G or more) and hence, it is not necessary to take with consideration the trouble of mixing the atmospheric gas (air) into the cover gas and the oxidation of the liquid metal by the atmospheric gas. In this case, since the cover gas is not rendered radioactive, it is harmless even if it leaks outside the gas line. It is not preferred to replace the gas line failed by the operation of the emergency gas line shut-off system because the high availability factor is preferentially desired. In this case, therefore, the operation of the emergency syphon system must be made first in preference to that of the emergency gas line shut-off system.

In the case of a mechanical pump for a primary cooling system of a fast breeder reactor, the cover gas pressure in such a pump is not very high (approximately 0.5 kg/cm$^2$G). In this case, since the atmospheric gas is nitrogen, it does not oxidize the liquid metal even if it mixes with the cover gas. The problem here is that, since the cover gas is rendered radioactive, the atmospheric gas would be contaminated if the cover gas leaks outside the gas line. To prevent the contamination, it is preferred that the emergency gas line shut-off system be operated first. From the aspect of the high availability factor on the other hand, the emergency syphon system must be preferentially operated for the same reason as in the case of the secondary cooling system. For the reasons described above, the preferential operation of these two systems must be selected synthetically in consideration of the concept of safety and the operation maintenance.

In the case of a mechanical pump for use in a liquid metal experimental loop, the availability factor is not as required. Since the atmospheric gas is air, the emergency gas line shutoff system must be preferentially operated in order to prevent the oxidation of the liquid metal.

If a design is made so that the emergency syphon system operates first, the freeze pots 41*a*, 41*b* do not operate so long as the emergency syphon pipe 47 operates normally. Nevertheless, the provision of these two systems is preferable from the aspect of the double safety in order to stop the leakage of the cover gas from the gas line and to prevent the rise of the free surface inside the pump in the event that the emergency syphon pipe 47 does not operate accidentally.

Figure 2:
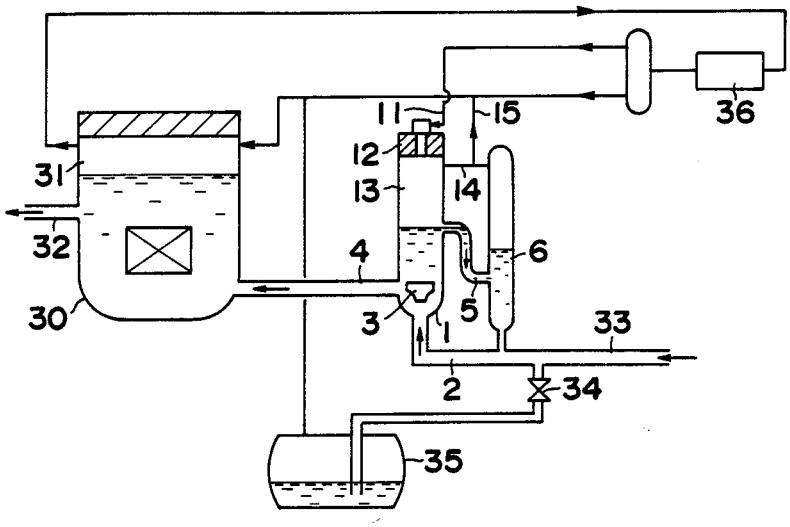
FIG. 2 PRIOR ART
FIG. 2 is a schematic view showing an example of the use of the conventional pump.
Figure 5:
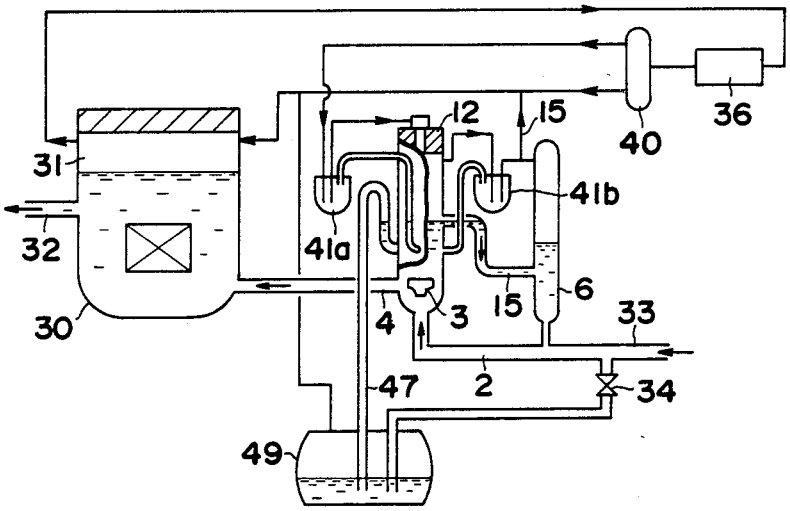
FIG. 5 is a schematic view showing an example of the use of the mechanical pump of the present invention.

FIG. 5 shows an example in which the mechanical pump of the present invention is used as a main circulation pump for the primary cooling system of a liquid metal cooled fast breeder reactor. In FIG. 5, like reference numerals are used to identify like constituents in FIGS. 2 and 3, and their explanation is omitted.

In the present invention, the emergency syphon pipe 47 is especially referred to as the "syphon" for the following reason. If a mere overflow pipe is connected at the level L5 in FIG. 3, the free surface inside the pump is held at this level L5 when it rises. However, the shield plug 12 of the pump is designed so as to have a predetermined heat shielding function at the ordinary level L4. If the free surface is held at an abnormally high level such as described above, therefore, it becomes impossible to hold the temperature at the mechanical seal 10 and the seal at the joint portion between the shield plug 12 and the casing 1, which is not shown in FIG. 3, below the predetermined values and this situation is very dangerous. In the case of the gas line failure which is assumed in the present invention, the free surface inside the pump drastically rises and after reaching the level L5, it rapidly drops due to the operation of the emergency syphon system of the present invention. Accordingly, no problem occurs in the pump of the present invention because the time in which the free surface reaches the level L5 is only for a short period of time. Strictly speaking, the fitting position L2 of the emergency syphon pipe 47 is defined by the following relation:

$$L1 \leqq L2 \leqq L4$$

If the level L2 is higher than L4, it is dangerous for the reason described above. The level L2 may be at an arbitrary position so long as it is between L1 and L4. At the time of failure which is assumed in the present invention, the operation can not be re-started unless repair is completed. For this reason, the level after the operation of the emergency syphon may be lower than the ordinary level range, i.e. L3 to L4, during the normal operation.

The explanation as to the freeze pot syphon pipes 42*a* and 42*b* is as follows. In FIG. 3, it is necessary to use a syphon for the freeze pot 41*a* and such a syphon can not be substitued by an overflow pipe. This is because, if the overflow pipe is used, the gas circulation which ascends from the freeze pot 41*a* via the gas feed line 11 and descends through the gap between the shield plug 12 and the shaft 7 can not be obtained. This gas fluidization is necessary in order to prevent the liquid metal vapor in the cover gas space inside the pump from ascending through the gap and reaching the mechanical seal 10.

Figure 6:
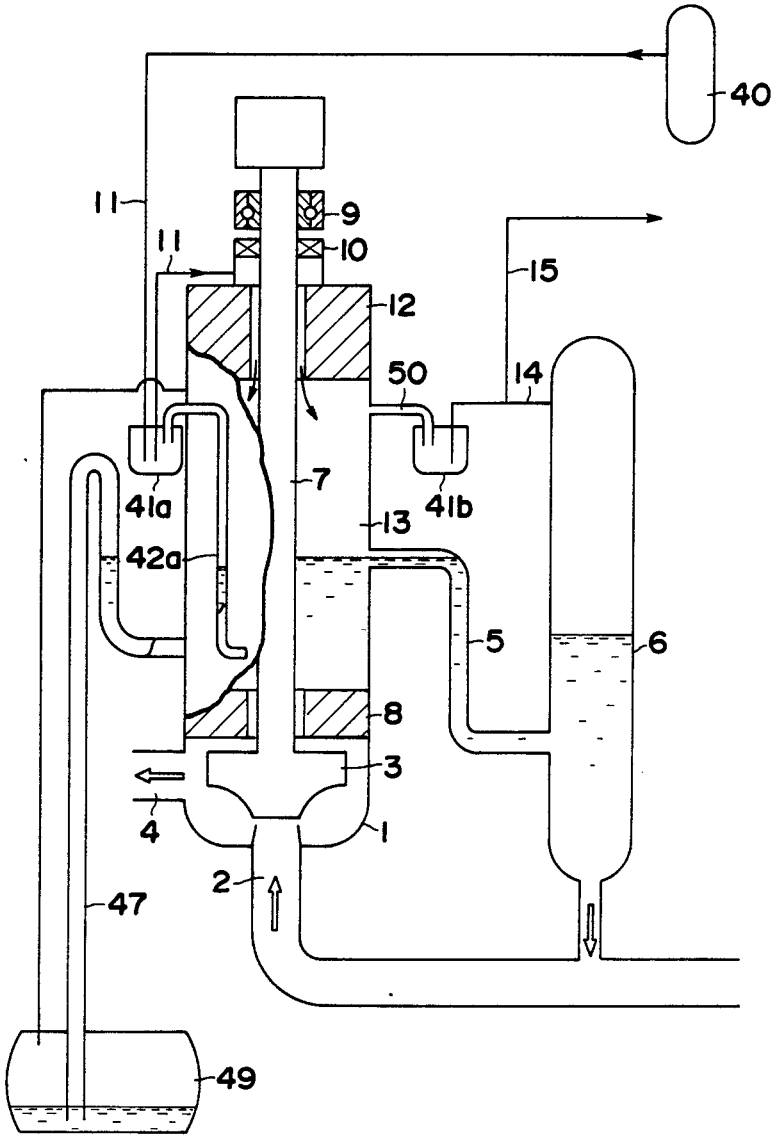
FIG. 6 is a schematic view showing another embodiment of the present invention.

In contrast, for the freeze pot 41*b*, an overflow pipe may be used. An example in such a case is shown in FIG. 6. This embodiment has a construction in which the pump casing 1 and the freeze pot 41*b* are connected to each other by an overflow pipe 50 with the rest being the same as the construction shown in FIG. 3. A heater and a heat insulating material are fitted around the outer circumference of the overflow pipe 50 so as to hold the pipe 50 at a temperature higher than the solidifying point of the liquid metal during the pump operation. This arrangement makes it possible to use the overflow pipe 50 also as the gas discharge pipe (reference numeral 14 shown in FIG. 3) and to simplify the piping arrangement.

Since the liquid metal mechanical pump according to the present invention is constructed as described in the foregoing specification, the free surface inside the pump does not rise up to the upper mechanical seal 10 of the pump at the time of the failure of the cover gas line and hence, the pump of the invention can prevent damage to the upper mechanical bearing 9 and the mechanical seal 10 and the leakage of the liquid metal outside the pump.

While the described embodiments represent the preferred form of the present invention, it is to be understood that changes and modifications will occur to those skilled in the art without departing from the scope of the appended claims.

What is claimed is:

1. A mechanical pump for liquid metal, including a drive shaft housing having therein a free surface of liquid metal and a cover gas space over said liquid metal free surface, a gas line for feeding a cover gas into said cover gas space, and a gas line for exhausting the cover gas from said cover gas space, said mechanical pump further comprising:

an emergency cover gas line shut-off system;

wherein said gas feed line is cut at the outside of and in the proximity of said drive shaft housing, resulting open ends of the gas feed line being inserted into a first air-tight freeze pot so as to communicate with each other via said first freeze pot;

wherein said gas exhaust line is cut at the outside of and in the proximity of said drive shaft housing, resulting open ends of the gas exhaust line being inserted into a second air-tight freeze pot so as to communicate with each other via said second freeze pot; and wherein said first and second freeze pots each being connected to said drive shaft housing via a first freeze pot pipe and a second freeze pot pipe, respectively, through which the liquid metal in said drive shaft housing flows out into said first and second freeze pots when the free surface of the liquid metal inside the drive shaft housing rises to a predetermined level higher than the level of the normal operation of the pump.

2. The mechanical pump according to claim 1, wherein said first and second freeze pots and said gas feed and exhaust lines are held at a temperature lower than the solidifying temperature of the liquid metal, and said first and second freeze pot pipes are held at a temperature higher than the solidifying temperature of the liquid metal.

3. The mechanical pump according to claim 1, wherein said open ends of the gas feed line and said open ends of the gas exhaust line are inserted into said first and second freeze pots, respectively, so as to extend as close as possible to the bottom of said freeze pots.

4. The mechanical pump according to claim 1, wherein each of said first and second freeze pot pipes is a syphon pipe.

5. The mechanical pump according to claim 1, wherein said first freeze pot pipe is a syphon pipe and said second freeze pot pipe is an overflow pipe.

6. The mechanical pump according to claim 1, further comprising:

an emergency syphon system, and a dump tank for liquid metal disposed outside the drive shaft housing, said emergency syphon system including an emergency syphon pipe means for connecting said drive shaft housing and said dump tank, said liquid metal in said drive shaft housing flowing out into said dump tank when the free surface of the liquid metal inside the drive shaft housing rises to a predetermined level higher than the level of the normal operation of the pump.

7. The mechanical pump according to claim 6, wherein said emergency syphon pipe is held at a temperature higher than the solidifying temperature of the liquid metal.

8. The mechanical pump according to claim 6, wherein a cover gas space inside the dump tank and the cover gas space inside the drive shaft housing are connected by a gas line.

* * * * *